United States Patent [19]

Tauber, Jr.

[11] 4,153,244

[45] May 8, 1979

[54] GYMNASTIC SET FOR WHEELCHAIR PATIENTS

[75] Inventor: Carl F. Tauber, Jr., Baltimore, Md.

[73] Assignee: Leonard F. Zullo, Baltimore, Md.

[21] Appl. No.: 815,693

[22] Filed: Jul. 14, 1977

[51] Int. Cl.[2] ..... A63B 21/06

[52] U.S. Cl. ..... 272/117; 272/62; 272/67; 272/142; 272/94; 272/123; 272/900

[58] Field of Search ..... 272/93, 109, 61, 62, 272/67, 68, 122, 142, 140, 117, 900, 94

[56] References Cited

PUBLICATIONS

3-Way Master Gym — Marcy Gym Equipment Co., catalog No. 71; 1970, cover page.

*Primary Examiner*—Richard C. Pinkham
*Assistant Examiner*—William R. Browne
*Attorney, Agent, or Firm*—Walter G. Finch

[57] ABSTRACT

Set of gymnasium equipment for use by wheelchair patients that is lightweight and portable, with specific apparatus for exercising muscles in the fingers, wrists, arms, ankles, neck, back, thighs, shoulders, and other parts of the body. A framework of tubular members surrounds the wheelchair on its two sides and the back. A portion of the tubular framework extends upward above the wheelchair to carry arm exercising devices on weighted cables. Other exercising devices for the hands are mounted on the side rails of the framework and for the arms across the main upright stanchions of the overhead framework. A framework, of tubular members is clipped to the main frame to extend in front of the wheelchair with leg exercise bars on weighted cables set into the clipped on framework. Other special exercising features are included. The gymnastic equipment is adjustable to fit variations in patient stature.

5 Claims, 5 Drawing Figures

GYMNASTIC SET FOR WHEELCHAIR PATIENTS

BACKGROUND AND SUMMARY OF THE INVENTION

The invention relates to gymnasium type equipment and in particular to gymnasium equipment for patients confined to a wheelchair. It must be understood that "confinement" is used in the broadest sense, and is not to be construed as meaning restriction to permanent confinement; the equipment is useful for temporarily incapacitated patients and for patients recovering from illness or accident or in a convalescing stage of recovery.

A need has existed for some time to provide a suitable exercising unit for patients confined to wheelchairs, or recuperating in wheelchairs either temporarily or permanently. A review of existing patents of the prior art reveals means for a patient using various devices to assist him in standing and subsequently walking. Some existing invention also provide for certain leg exercises. This invention provides all of these features, and many more, in an improved system and structure.

The invention generally consists of a framework that surrounds the wheelchair at the back and on the two sides. The front, has apparatus that is connected to the framework after the wheelchair and patient are in place.

Mounted on the framework are various pieces of apparatus such as bars, weights, torque-type devices, and other similar equipment so that the patient may complete numerous exercises as provided by a physical therapist.

The framework is adjustable in relation to the floor level so that variations in patient height and stature, or wheelchair configuration, can be accommodated.

Variations in the weights are accomplished through the use of pullies and a facility for modifying the actual weight.

It is therefore an object of the invention to provide a set of gymnasium equipment for use by wheelchair confined patients.

It is a further object of the invention to provide gymnastic equipment for wheelchair patients that is adjustable to meet variations in size or stature of patients.

It is another object to provide a gymnastic device for wheelchair patients that has numerous pieces of specialized equipment for exercising individual parts of the body as specified by a physical therapist.

It is yet another object of this invention to provide a gymnastic exercising device for wheelchair patients that is portable.

Further objects and advantages of the invention will become more apparent in light of the following description of the preferred embodiments.

DESCRIPTION OF THE PREFERRED EMBODIMENT

Figure 1:
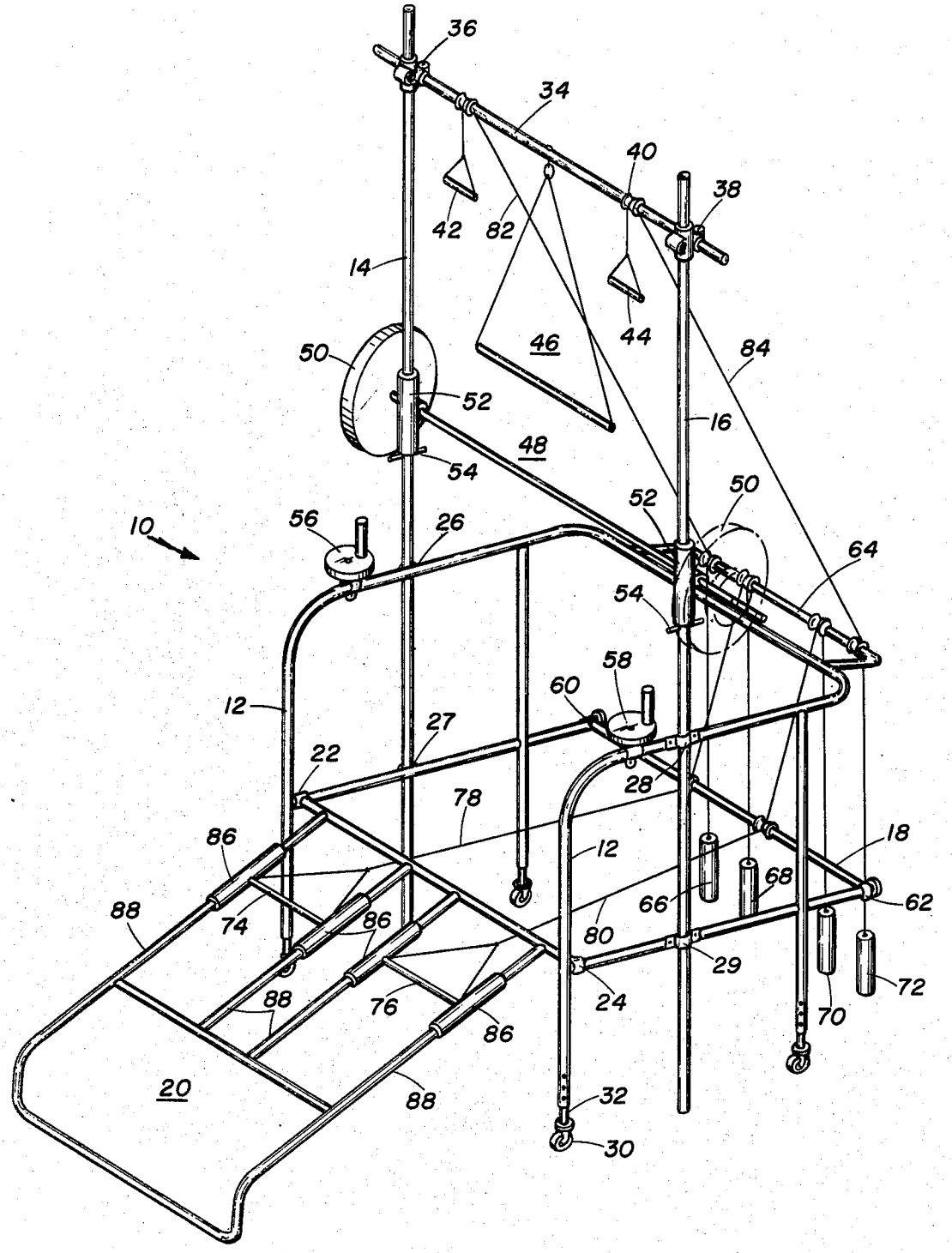
FIG. 1 is a pictorial view of the complet unit.

Referring to the drawings and particularly to FIG. 1 an improved gymnastic exercising set for wheelchair patients is shown at 10. The various parts of the structure will be described hereinafter.

The basic frame 12 can be seen as a three sided framework which will fit around a wheelchair. Essentially the wheelchair is backed into the frame 12 before the foot and leg exercising assembly 20 is put in place. Alternatively, the framework 12 may be moved into place around the wheelchair instead of backing the wheelchair into the framework 12.

Adjustment to the height of the gymnastic set 10 is provided by the height adjustment mechanism 32. This height adjustment mechanism 32 makes it possible to use the gymnastic set 10 for any height of patient or patient and wheelchair combination. It should be noted that there are other adjustments of equipment that also relate to height that will be described hereinafter.

Mobility for moving the gymnastic set 10 into position and making it portable is provided by the rollers or casters 30 mounted at the bottom of the four vertical corner posts of the frame 12.

Describing now the exercise apparatus that is placed across the front of the gymnastic set 10 when a patient in a wheelchair is within the gymnastic set 10 for a therapeutic exercise session, the exercise apparatus across the front is the foot and leg exercising assembly 20. This foot and leg exercising assembly 20 is a completely fabricated unit and attaching clips 22 and 24 rest on the lower horizontal side rails of the frame 12, next to and immediately back of the vertical front posts of frame 12. These attaching clips 22 and 24 are more or less like an inverted "U" of a configuration that mates with said lower horizontal side rails of the frame 12.

The structure of the foot and leg exercise assembly 20 consists of a frame 88, the side rails and intermediate rails of which serve as slide bars for slides 86, hereinafter described. The frame 88, in addition to the aforementioned side and intermediate rails, has connecting cross members at the top and bottom ends and at one intermediate position. the aforementioned intermediate rails are positioned between said top cross member and said intermediate cross member. The top cross member of frame 88 has the aforementioned attaching clips 22 and 24 assembled on the ends thereof. The bottom cross member is a continuation of said side rails of frame 88, wherein said side rails are bent downward at approximately 90° near the end and thereafter join, as a continuation, said bottom cross member. Said bend of approximately 90° serves to elevate the framework to clear the floor surface.

The previously mentioned slides 86 are four in number, one each on each said side rail and one each on each said intermediate rail. The pairs of slides 86 (a pair being one on a side rail and one on an adjacent intermediate rail) are permanently secured together in alignment and position by cross braces 74 and 76 respectively. Said cross braces 74 and 76 also serve as foot bars for therapeutic exercising and hereinafter will be referred to as foot bars 74 and 76.

The foot and leg exercise assembly 20 operates with a pair of pulley and weight systems as now described. Cords or cables 78 and 80 extend from the foot bars 74 and 76, over a pair of pulleys on the lower rear horizontal rail 18 of the frame 12 and over a pair of pulleys on the bracket extension 64 to weights 68 and 70. These weights 68 and 70 may be of a constant predetermined weight, or they may be variable by adding increments in the form of solid unit weights. An alternative is to have the weights 68 and 70 in the form of hollow containers and then using a filler, such as water or lead shot, to vary the weight being utilized.

The cords or cables 78 and 80 are attached to the foot bars 74 and 76 by a sling-type arrangement as shown in FIG. 1 so as to provide clearance for the patient's foot.

Thus, foot and leg exercises are performed by the patient pressing outwardly and downwardly with the feet positioned on the foot bars 74 and 76. Resistance in this exercise is provided by the weights 68 and 72 through the cords or cables 78 and 80. .

Figure 3:
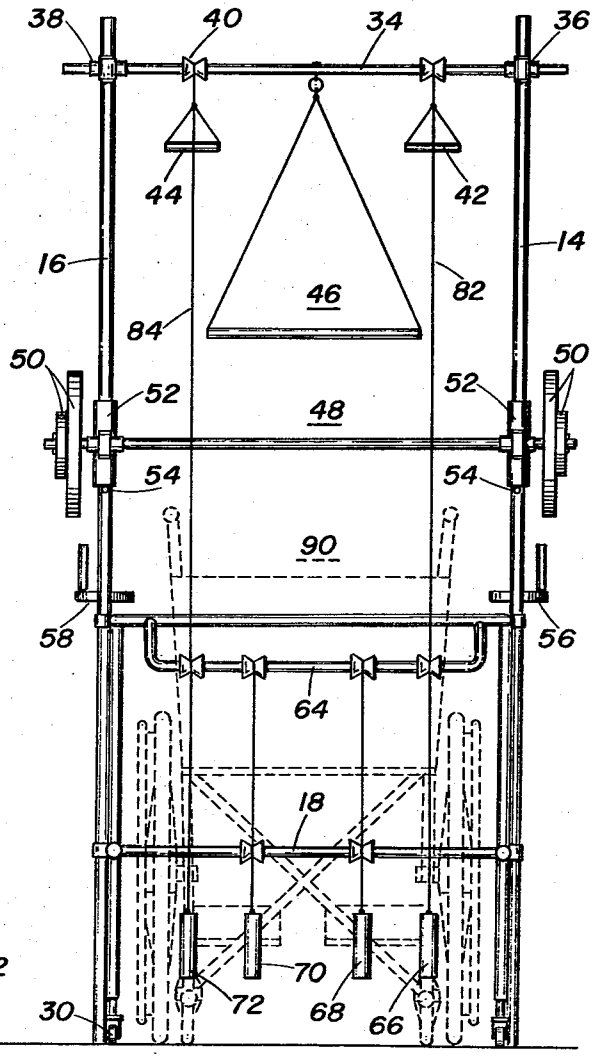
FIG. 3 is a rear elevation of the gymnastic set.
Figure 2:
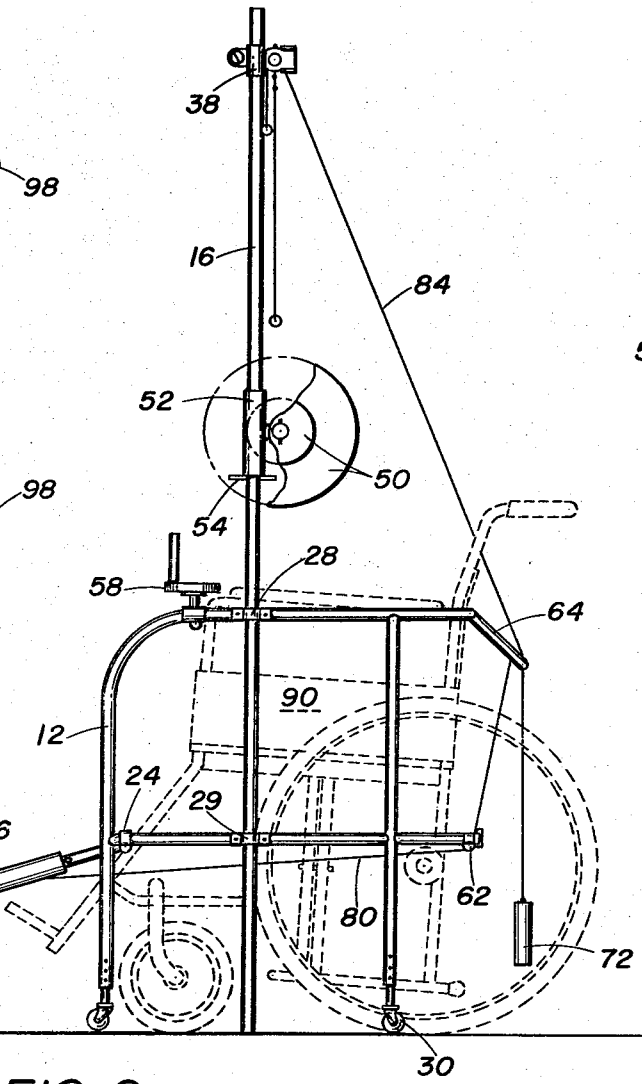
FIG. 2 is a side elevation of the gymnastic set.

To understand the positioning of the wheel chair within the gymnastic set 10 and the operation of the exercising units, a typical wheelchair 90 is shown in phantom lives in FIGS. 2 and 3.

Another exercising feature of the gymnastic set 10 for exercising the fingers, hands, and wrists (and associated muscles in the arms) is the two torque devices 56 and 58, located on the top horizontal rail of frame 12 on either side of the patient. These torque devices 56 and 58 operate by varying the torque required to turn them by turning screw that change the force required to turn them. The extended handle can be gripped by the fingers or by the hand to perform the exercise against the establish torque resistance.

Another exercise unit of the gymnastic set 10 is the "push up" or bar-bell type exercise unit assembly 48. This unit consists of two vertical posts or slide bars 14 and 16, a pair of slides 52 that mate with and slide on the vertical slide bars 14 and 16, a set of variable weight plates 50 on a cross bar between the aforementioned pair of slides 52.

The vertical slide bars 14 and 16 are secured to the horizontal top side bars of frame 12 by clamps 26 and 28, and to the bottom side bars of frame 12 by clamps 27 and 29.

The vertical slide bars 14 and 16 are held in position at the very top by cross bar 34, which is fastened to the vertical slide bars 14 and 16 by clamps 36 and 38.

The downward travel of the slides 52 on the vertical slide bars 14 and 16 is limited by the strap pins 54 which extend through the vertical slide bars 14 and 16 and project on either side thereof.

To use this bar-bell type weight lift 48, the patient merely extends the arms more or less vertically and grasps the horizontal bar that holds the weight plates 50 and pushes upward often referred to as a "press" lift.

It should be noted the weight plates 50 and the bar that holds them may be removed so that access can be had to the other exercise units above the position of this bar-bell type unit.

A pull-up, or chinning exercise, may be performed on the pull-up bar assembly 46. Said pull-up bar assembly 46 is suspended by a cable sling from the crossbar 34.

Another exercise for the arms, shoulders, back, and other associated muscles may be performed by the pair of weighted hand pulls 42 and 44. The cords or cables 82 and 84 of these hand pulls extend over pulleys 40 on the cross bar 34, across pulleys on bracket extension 64, to weights 66 and 72. Weights 66 and 72 are the same in use and operation as the aforementioned weights 68 and 70.

The lower horizontal rail 18 at the rear of the frame 12 is shown connected to the lower horizontal side rails of frame 12 by attaching clamps 60 and 62 at each end of said rails. This rail 18 is inserted through the openings in the wheels of the wheel-chair so that the movement of the wheel chair is immobilized.

In performing these exercises it should be noted that once the wheel-chair is in position inside the gymnastic set 10 it is held in a stationary position so that as the patient performs the execercises the wheel-chair cannot move out of position.

Figure 4:
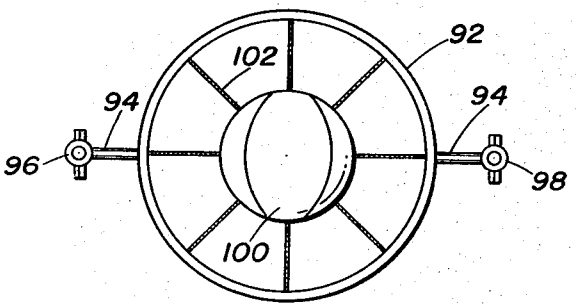
FIG. 4 is a top plan view of an attachment for exercising the head.
Figure 5:
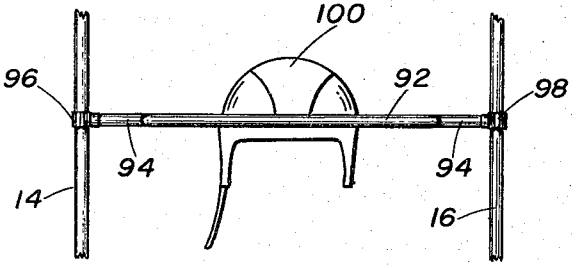
FIG. 5 is a front view of FIG. 4.

In patients that use wheel-chairs it is often necessary to provide special exercises for the muscles in the neck that attach to the head. A special attachment is provided for such exercises as shown in FIGS. 4 and 5 and as described below.

A ring 92 with attached side bars 94 on each side of said ring 92 is attached to the vertical slide bars 14 and 16 in a fixed position by clamps 96 and 98. The ring 92 can thus be set at any desired height to accommodate a patient in a wheel-chair 90.

Within the ring 92 is a plurality of spaced springs 102 that are attached at one end of each around the inside of said ring 92 at spaced intervals, and the other end of each of said plurality of spaced springs is attached to the exterior surface of a helmet 100 (similar to a bicyclist or motorcyclist helmet). The attachments of said springs 102 to said helmet 100 are at comparable spaced intervals to the spaced attachments at the inside of ring 92. Thus, the springs 102 radiate outwardly from the helmet 100 in a fashion similar to the spokes of a wheel.

For exercising said neck muscles leading to the head the helmet 100 is strapped to the head of a patient with a chin strap the same as a motorcyclist or bicyclist uses a helmet.

The material of this invention is preferably of metal, made integrally where appropriate, welded if necessary, and clamped as shown where connections must be made from time to time. However, it is to be noted that variations in material and manner of fabrication may be varied without departing from the scope and intent of this invention.

Accordingly, modifications and variations to which the invention is susceptible may be practiced without departing from the scope of the appended claims.

What is claimed is:

1. A gynmastic exercise system for wheel chair patients comprising:

a base framework surrounding two sides and the back of a wheelchair, said base framework having a super-structure above a wheelchair and a lower framework removably attached to said base framework in front of a wheelchair;

a plurality of exercise structures connected to said base framework, said super-structure, and said lower framework;

a left horizontal top side rail;

a left horizontal bottom side rail spaced apart from said left top side rail parallel thereto and in the same vertical plane as said left top side rail and spaced from a floor;

a right horizontal top side rail parallel to said left horizontal top rail and spaced apart from said left horizontal to rail;

a right horizontal bottom side rail spaced apart from said right top side rail and parallel thereto and in the same vertical plane as said right top side rail and spaced from a floor;

a vertical left front post extending from said left horizontal top side rail and connected thereto and extending downward to a floor and further connected to said left horizontal bottom rail;

a vertical right front post extending from said right horizontal top side rail and connected thereto and extending downwardly to a floor and further connected to said right horizontal bottom rail;

a vertical left rear post extending from said left horizontal top side rail and connected thereto and extending downwardly to a floor and further connected to said left horizontal bottom rail;

a vertical right rear post extending from said right horizontal top side rail and connected thereto and extending downwardly to a floor and further connected to said right horizontal bottom rail;

a rear transverse top rail connected to said left horizontal top rail at rear end thereof and connected to said right horizontal top rail at rear end thereof, so as to permanently space said left horizontal top rail from said right horizontal top rail to clear a typical wheelchair and form the framework into a single unit;

a support bar for cable pulleys spaced apart from and attached to said rear transverse top rail, attachment being made at the ends of said support bar;

a rear transverse bottom rail removably connected to said left horizontal bottom rail at rear end thereof and removably connected to said right horizontal bottom rail at rear end thereof, said rear transverse bottom rail serving as a support bar for cable pulleys, said rear transverse bottom rail serving to immobilize the unit by passing through the wheels of said wheelchair;

a super-structure for said base framework comprising two long vertical posts, one right and one left, extending from a floor to a point above a wheelchair, said long vertical posts each connected to said respective left and right horizontal top and bottom side rails, and having a traverse bar at the upper end of said two long vertical posts and connected thereto, said transverse bar serving as a support bar for cable pulleys and as a support several exercise structures; and a lower framework for said base framework comprising a more or less "U" shaped member connected at the free ends to a horizontal member which in turn is removably connected to said left and right horizontal bottom rails, and "U" shaped member having connected therein a leg exercise structure.

2. The exercise system as recited in claim 1 and additionally, a caster mounted to the bottom of each said vertical post to provide mobility and each said caster adjustable in height so as to provide vertical height adjustment for said base framework.

3. The exercise system as recited in claim 1 wherein said plurality of exercise structures consists of:

a weighted foot and leg exercise unit connected to said lower framework;

a torque exercise unit for fingers, hands, wrists, and associated arm muscles connected to said left and right horizontal top side rails of said base framework;

a weighted bar-bell exercise unit removably mounted on said super-structure;

a pull-up horizontal bar connected to said super-structure;

a pair of weighted arm exercise units connected to said super-structure; and a head and neck exercise unit removalby connected to said super-structure.

4. The exercise system as recited in claim 2 wherein said weighted units posses a variable weight capability, said weighted units for foot and leg exercises and arm exercises having weights hanging on cables passing over pulleys on said support bars.

5. The exercise system as recited in claim 2 wherein said plurality of exercise structures are each separately demountable from said framework or super-structure to which connected or attached.

* * * * *